US009339774B2

(12) United States Patent
Matula

(10) Patent No.: US 9,339,774 B2
(45) Date of Patent: May 17, 2016

(54) METHOD AND APPARATUS FOR MIXING VARIOUS FLOWS INTO A PROCESS LIQUID FLOW

(75) Inventor: Jouni Matula, Savonlinna (FI)

(73) Assignee: WETEND TECHNOLOGIES OY, Savonlinna (FI)

( * ) Notice: Subject to any disclaimer, the term of this patent is extended or adjusted under 35 U.S.C. 154(b) by 696 days.

(21) Appl. No.: 13/608,711

(22) Filed: Sep. 10, 2012

(65) Prior Publication Data

US 2013/0058186 A1 Mar. 7, 2013

Related U.S. Application Data

(63) Continuation-in-part of application No. PCT/FI2011/050199, filed on Mar. 8, 2011.

(30) Foreign Application Priority Data

Mar. 10, 2010 (FI) ..... 20105230

(51) Int. Cl.
*B01F 3/08* (2006.01)
*B01F 5/04* (2006.01)
*B01F 13/00* (2006.01)

(52) U.S. Cl.
CPC ..... *B01F 3/0865* (2013.01); *B01F 5/048* (2013.01); *B01F 5/0475* (2013.01); *B01F 5/0478* (2013.01); *B01F 13/0001* (2013.01)

(58) Field of Classification Search
CPC ..... B01F 3/0865; B01F 5/0062
USPC ..... 366/173.1–173.2
See application file for complete search history.

(56) References Cited

U.S. PATENT DOCUMENTS

| | | | | | |
|---|---|---|---|---|---|
| 1,120,534 | A | * | 12/1914 | Pruden | 366/102 |
| 1,157,092 | A | * | 10/1915 | Du Rell | 241/39 |
| 3,124,160 | A | * | 3/1964 | Zilberfarb | 137/829 |
| 3,183,065 | A | * | 5/1965 | De Bolt | 422/231 |
| 3,199,268 | A | * | 8/1965 | Oehlrich et al. | 96/372 |
| 3,199,269 | A | * | 8/1965 | Oehlrich et al. | 96/372 |
| 3,238,021 | A | * | 3/1966 | Webber et al. | 422/224 |
| 3,306,587 | A | * | 2/1967 | Schroedter | 366/162.4 |
| 3,386,182 | A | * | 6/1968 | Axel | 34/364 |
| 3,426,780 | A | * | 2/1969 | Gray | 137/824 |

(Continued)

FOREIGN PATENT DOCUMENTS

| | | |
|---|---|---|
| CN | 101632905 | 1/2010 |
| EP | 1 254 700 | 11/2002 |

(Continued)

OTHER PUBLICATIONS

Chinese Second Official Action, Supplementary Search Report and its English translations issued in corresponding Chinese Patent Application No. 201180013220.2 mailed Jul. 16, 2014.

*Primary Examiner* — Charles Cooley
*Assistant Examiner* — Abbas Rashid
(74) *Attorney, Agent, or Firm* — Nixon & Vanderhye P.C.

(57) ABSTRACT

A method of introducing a first flow and a second flow into a process liquid flowing through a conduit including: injecting the first flow with an introduction liquid into the process liquid in transverse to a flow direction of the process liquid, wherein the injected first flow forms a mixing field comprising counter-rotating vortices in the process liquid; and injecting a second flow transverse to the flow direction of the process liquid and between the counter-rotating vortices.

8 Claims, 3 Drawing Sheets

(56) References Cited

U.S. PATENT DOCUMENTS

| | | | | | |
|---|---|---|---|---|---|
| 3,648,985 | A | * | 3/1972 | Matweecha | 366/107 |
| 3,718,319 | A | * | 2/1973 | Weisman | 366/134 |
| 3,751,011 | A | * | 8/1973 | Milik | 366/60 |
| 3,763,936 | A | * | 10/1973 | Menage | 169/45 |
| 3,851,404 | A | * | 12/1974 | Fracke et al. | 34/573 |
| 3,871,583 | A | * | 3/1975 | Kellert | 239/302 |
| 4,060,041 | A | * | 11/1977 | Sowards | 110/245 |
| 4,073,712 | A | | 2/1978 | Means et al. | |
| 4,215,081 | A | * | 7/1980 | Brooks | 261/122.1 |
| 4,308,806 | A | * | 1/1982 | Uemura et al. | 110/244 |
| 4,428,973 | A | * | 1/1984 | Horner et al. | 427/2.15 |
| 4,441,822 | A | * | 4/1984 | Biswas et al. | 366/101 |
| 4,454,661 | A | * | 6/1984 | Klein et al. | 34/594 |
| 4,564,298 | A | * | 1/1986 | Gritters et al. | 366/173.2 |
| 4,573,803 | A | * | 3/1986 | Gritters et al. | 366/173.2 |
| 4,963,329 | A | | 10/1990 | Burgess et al. | |
| 5,076,327 | A | * | 12/1991 | Mettner | 137/809 |
| 6,109,778 | A | * | 8/2000 | Wilmer | 366/137 |
| 6,234,664 | B1 | * | 5/2001 | Tromley | 366/162.4 |
| 6,357,906 | B1 | * | 3/2002 | Baudoin et al. | 366/163.2 |
| 6,488,402 | B1 | * | 12/2002 | King et al. | 366/173.2 |
| 6,764,212 | B1 | | 7/2004 | Nitta et al. | |
| 6,821,011 | B1 | * | 11/2004 | Crump | 366/137 |
| 7,523,603 | B2 | * | 4/2009 | Hagen et al. | 60/39.55 |
| 2005/0248049 | A1 | | 11/2005 | Gannaway et al. | |

FOREIGN PATENT DOCUMENTS

| | | | |
|---|---|---|---|
| EP | 1 481 724 | | 12/2004 |
| FR | 2 477 674 | | 9/1981 |
| GB | 1 357 783 | | 6/1974 |
| GB | 2 087 249 | | 5/1982 |
| JP | 53-86678 | | 7/1978 |
| JP | 57-084800 | | 5/1982 |
| JP | 2000-70688 | | 3/2000 |
| JP | 2000-265945 | | 9/2000 |
| JP | 2001018206 | | 1/2001 |
| JP | 2002136855 | | 5/2002 |
| JP | 2002-186840 | | 7/2002 |
| JP | 2003-93860 | | 4/2003 |
| JP | 2005-46651 | | 2/2005 |
| JP | 2005-147479 | | 6/2005 |
| JP | 2006-167624 | | 6/2006 |
| JP | 2008-289993 | | 12/2008 |
| WO | 97/14654 | A1 | 4/1997 |
| WO | 2009/117141 | A1 | 9/2009 |
| WO | 2009151616 | | 12/2009 |

* cited by examiner

Fig. 2b ( A - A)

METHOD AND APPARATUS FOR MIXING VARIOUS FLOWS INTO A PROCESS LIQUID FLOW

RELATED APPLICATION

This is a continuation-in-part application based on PCT/FI2011/050199, designating the U.S. and having an international filing date of 8 Mar. 2011, and claiming priority to Finnish patent application 20105230 filed 10 Mar. 2010, the entirety of which applications are both incorporated by reference.

BACKGROUND OF INVENTION

The present invention relates to a method and apparatus for mixing various flows into a process liquid flow. The present invention is suitable for use in processing process liquids of all industrial branches. Introducing various chemicals into the stocks, stock components and fibrous suspensions of paper and pulp industry can be mentioned as an especially preferable application for the method and apparatus according to the invention.

In the following description, embodiments of the present invention are described in the context of papermaking. This must, however, be understood only as one example of the various applications of the invention, because similar applications for mixers, problems with mixing and desire to solve them can be found at a wide variety of industrial branches. In papermaking, similar to countless other branches of industry, there are needs for mixing a substance, hereinafter called a chemical in the widest possible meaning of the term, whereby the term covers plain water (more generally a liquid), air (more generally a gas or steam) as well as introducing some other solid material, not excluding various treatment chemicals and other chemicals, into a pipe flow. In some cases it is enough to let the desired amount of chemical to flow into a pipe flow so that it is mixed with the flowing material, a liquid or a gas, by the turbulence in the actual pipe flow. Sometimes the desired amount of the chemical is drained into such a point of a pipe flow where there is a turbulence-producing mechanical apparatus slightly after the chemical addition point, either a static flow hindrance, a rotary mixer or, for example, a centrifugal pump. In some cases the chemical is introduced into a relatively large tank arranged in the process, either directly or, for example, with a substance directed into the tank, whereby the necessary mixer is arranged in the tank.

In many cases there however is a need for a considerably faster and more efficient method of mixing. An example of such could be, e g mixing a chemical with very fast reactions, such as ozone, into cellulosic fiber suspension. If the mixing is carried out slowly, ozone has time to spoil the part of the pulp located close to the chemical introduction opening while a part of the pulp remains totally untreated, because the ozone does not have the time to reach said portion of the pulp, but it is instead used up earlier. Such a chemical needs a very fast and complete method of mixing.

Another example could be, e.g. introducing into the stock two such chemicals that are supposed to react with each other and to form filler particles of even size or to form, for example, micro flocks with the fibers or the fine material of the stock. If slow mixing methods are used in such applications, it is obvious that there are, e.g. the following kinds of problems:

(i) The size of the particles varies within a wide range because the whole time when both chemicals are present in the stock both new particles are formed and the size of the old particles is increased.

(ii) This also applies to the formed flocks, the size of the flocks varies for exactly the same reason.

(iii) Further, as the purpose is to fasten the fine material of the stock to the fibrous material by means of retention chemicals, they must be introduced in such an amount that there surely is enough for all places of the stock flow despite the long duration of the mixing.

The above-mentioned problems are also discussed in patent documents EPB11064427, EP-B1-1219344, FI-B-111868, FI-B-115148 and FI-B-116473 of Wetend Technologies Oy, in which injection mixing using injection liquid is presented as a solution for fast mixing. Suitably arranging the injection nozzles to the circumference of the process pipe so that one mixer is sufficient for pipes of small diameter, slightly larger pipes use two opposing nozzles on the same circumference, pipes slightly larger than this need three nozzles located at 120 degree intervals on the circumference and so on, provides the currently operationally best mixing arrangement for e.g. introduction of the retention chemicals of papermaking and corresponding mixing.

As there is in some applications a need to introduce a number of chemicals essentially simultaneously, document FI-B-116473 discloses an introduction arrangement in which in the nearhood of the injection nozzle discussed in the above-mentioned patents there is, directly upstream thereof, an opening wherefrom a second chemical is allowed to flow in desired amounts to the flow/process pipe with a just sufficient pressure difference so that the second chemical flows along the inner surface of the process pipe to the opening of the injection nozzle, wherefrom the fast jet of injection liquid and the second chemical entrains and mixes the second chemical as well into the process liquid.

However, the following problems, among others, have been found in the above-mentioned solutions:

(i) in most demanding conditions the mixing is not as efficient and fast as desirable.

(ii) one injection jet is not sufficient for mixing a very large amount of a second chemical.

(iii) in some cases there has been a need for a relatively long distance between the introduction points of the two chemicals, i.e. of the order of >2 seconds, for the first chemical to be mixed evenly enough into the whole flow. In practice, in the short circulation of a paper machine, for example, this means a distance of over five meters between two mixers.

It is worth mentioning, as a separate problem from the previous problems, the tendency of some chemicals or their reaction products to precipitate on or fasten to the surfaces of all solid materials. Thus there can be, in addition to the desirable precipitation on the surfaces of the fibers of the stock or other solids in the suspension, also precipitation on or fastening to the surfaces of the actual process pipe or the structures located therein (including the various surfaces of the mixer). Such a precipitation or fastening is by no means desirable, as at some point the precipitation or particles/pieces detaching therefrom will in some way be detrimental to the production of the final product or even detrimental to the quality of the final product.

SUMMARY OF INVENTION

The invention may be used to provide a solution to at least some of the prior art problems mentioned above. A novel type of mixing apparatus is disclosed herein that operates efficiently and reliably when mixing both chemicals reacting easily and quickly and a number of chemicals nearly simultaneously to a process flow. Similarly, a novel method is disclosed herein in which both an easily and quickly reacting chemical and a number of chemicals can be mixed into a process flow nearly simultaneously in an efficient and simple way.

The method disclosed herein for introducing various flows into a process liquid flow comprises the steps of introducing a first flow by injecting it with introduction liquid into the process liquid running in the process pipe, performing the introduction essentially perpendicularly to the flow direction of the process liquid for forming a mixing field, the mixing field of the first flow comprising two counter-rotating vortices in the process pipe, and introducing a second flow essentially perpendicularly to the flow direction of the process liquid by injecting it into the process liquid between the vortices for enhancing the mixing field formed by the first injection flow.

The apparatus disclosed herein for introducing various flows into a process liquid flow, comprises a process pipe carrying the process liquid and at least one injection mixer introducing and mixing the first flow into the process pipe essentially perpendicularly in relation to the flow direction of the process liquid, the mixer being attached to the wall of the process pipe, wherein at least one injection mixer introducing and mixing a second flow essentially perpendicularly in relation to the flow direction of the process liquid is located on the wall of the process pipe at essentially the same plane traversing through the axis of the process pipe, downstream and at a distance from the at least one injection mixer introducing the first flow, the injection mixers introducing the first flow and the second flow forming an injection mixer pair.

In performed tests, the advantages achieved by means of the invention included:

(i) The chemical is mixed evenly enough for most purposes in less than a second, sometimes in less than 0.1 seconds.

(ii) The reaction of two chemicals reacting with one another also takes place in less than a second.

(iii) The size distribution of the crystals formed in the reaction of the chemicals (such as precipitated calcium carbonate, (PCC)), or more generally, the size distribution of the product is very even, in fact more even than e.g. in any known production method of PCC.

In embodiments of the invention, the precipitation on or fastening of the chemical/chemicals and/or its reaction products to the surface of the process pipe can be prevented, because the area of occurrence of the precipitations is shortened to a dimension realistic for the available cleaning method. The efficient and fast mixing apparatus of the invention provides a possibility to use or develop more aggressive chemicals and additives.

SUMMARY OF DRAWINGS

The method, apparatus and the operation thereof according to the invention are described in more detail with reference to the appended schematic figures, in which:

FIGS. 2A and 2B schematically show the structure and operation of a chemical injection mixing apparatus according to an embodiment of the invention.

DETAILED DESCRIPTION OF INVENTION

Figure 1B:
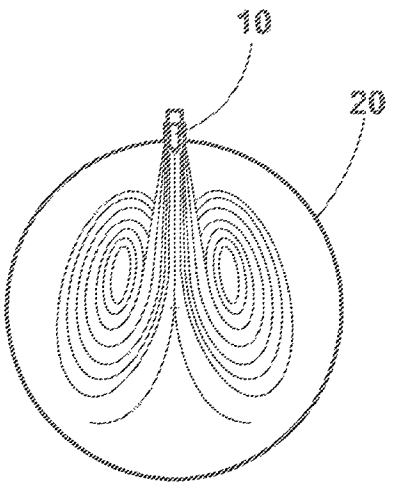
Fig. 1b (Prior Art)
FIGS. 1A and 1B schematically show the location and operation of a prior art injection feeder.

The invention may be applied to a process pipe in an industrial process, the pipe carrying a process liquid to a process step, including the production of final product or, for example, the carrying of a process liquid to a tank for transport to further refining or final use. The process liquid can contain one or more liquid and/or gaseous component and it can also contain solids of one type or more types. An example of the latter alternative includes the fibrous suspension of paper industry, i.e. stock, consisting of at least water, fibers, fines and filler particles. In the following the invention is disclosed in more detail with reference to an example of paper industry by comparing the present invention to a prior art use of injection mixer apparatus for producing precipitated calcium carbonate (PCC).

Successful use of an injection mixer in e.g. in-line production of PCC in papermaking industry has been discussed in patent application WO-A2-2009103854. This document discloses how the introduction of chemicals has been carried out by arranging the injection mixers used for introducing carbon dioxide and lime milk so that the distance reserved for the mixing in connection with pipe flow is from 5 to 15 meters, corresponding to about 1 to 5 seconds in time on the basis of a flow rate of about 3 to 5 m/s in a headbox approach pipe. The method disclosed in the patent application already provides an exceptionally good quality and even distribution of PCC when compared with prior art, even though there still is room for improvement for both the reaction time and the distance provided as well as the quality of PCC.

Arranging a reactor having a length of 5 to 25 meters into a process pipeline, whether in papermaking industry or in any other industry, can understandably be problematic. A problem with the production of especially PCC, as well as many other products is the tendency of the introduced at least one chemical or its reaction product or products to precipitate on the surface of the process pipe or on the surface of one or more structures in the process pipe or to attach thereto. Should it be desired to prevent this by using a special cleaning apparatus, the length of the cleaning apparatus should be extended to the whole length of the mixing/reaction zone, whereby it is obvious that placing a cleaning apparatus with a length of ten meters will cause problems and it is not inexpensive as an investment.

As far as the quality of PCC is concerned, its in-line production requires introducing and mixing of carbon dioxide (CO2) and lime milk (Ca(OH2)) into stock or a stock component or partial flow used in papermaking flowing towards the headbox of the paper machine. When using PCC as filler in papermaking, it is essential for the quality of the paper, as has been stated above, that the PCC crystals be as evenly sized and shaped as possible. It is previously known that the deviation of the crystal size of PCC depends almost entirely on how long the crystallization reaction of PCC lasts. In other words, the longer the time used for crystallization, the larger the size deviation of the formed crystals. The reason is simply that new crystals are continuously formed while the crystallization continues on the surface of previously formed crystals.

It is thus obvious that in the production of PCC it is advantageous to try to achieve as short a crystallization reaction time as possible. As the crystallization itself as a chemical reaction is of very short duration, some other factor must be of crucial importance when discussing the whole duration of the crystallization reaction. The only thing having an effect on the total duration of crystallization, in addition to the chemical reaction time, is material transfer, i.e. how the carbonate ions (CO32−) and calcium ions (Ca2+) find each other. According to tests performed by us the factors having an effect on the time are in fact only the bubble size of carbon dioxide, the particle size of lime milk and the intensity of the mixing. Same tests have proven that e.g. the desired amount of crystals, i.e. the amount of chemicals used (a realistic amount in the context of producing filler for papermaking) does not have much effect on the reaction time, as long as the mixing can be made as even as possible and the size of the bubbles and particles very small. The reason for this is that if the amount of chemicals introduced is stoichiometric in relation to each other, the chemicals react with each other without considerable delay needed for material transfer, as long as the mixing is fast and even.

Thus, the purpose of the tests performed by us has been to observe, with production of PCC as an example, how fast a mixing can be made to take place with injection mixers and by what means. Naturally, in such as case the starting point must be a thorough research of the operation of an injection mixer with emphasis on observing whether injection mixing can in some way be improved.

Figure 1A:
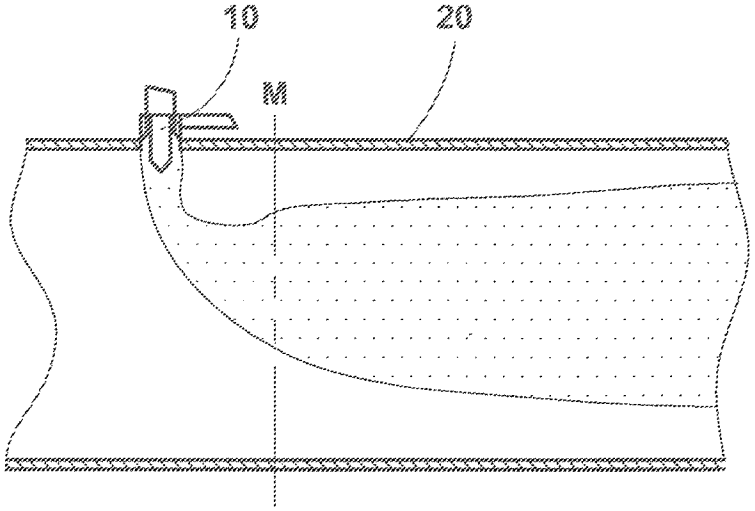
Fig. 1a (Prior Art)

FIG. 1A is a schematic illustration of a prior art injection mixer 10 and the flow field formed by it in the process pipe 20 carrying process liquid as a section in the longitudinal direction of the process pipe 20.

FIG. 1B shows the flow field formed by the mixer of FIG. 1*a* in a pipe at such a point of the cross-section of the pipe that the chemical jet discharged from the injection mixer must be considered as having reached its maximal penetration in the process pipe. From this point on, further mixing occurs in practice only due to the natural turbulence of the flow. The figures show that when introducing chemical in accordance with a prior art method by injecting it essentially perpendicularly in relation to the flow direction of the process liquid (at right angles to the process liquid +/−30 degrees) and with the injection velocity being high (3 to 12 times) when compared with the flow velocity of the process liquid in the process pipe 20 as it leaves the nozzle of the injection mixer 10, the jet maintains its shape and direction for a certain distance due to the high kinetic energy of the jet. In FIGS. 1*a* and 1*b* this corresponds with the extension of the jet to about from a third to a fourth of its maximum extension. Subsequent to this the jet first starts to fold into the direction of the flow (to the right in FIG. 1*a*), after which it starts to widen to the sides (as can be seen from FIG. 1*b*). The widening to the sides happens so that on the edge areas of the jet the velocity of the jet is reduced faster than in the middle of the jet due to both the kinetic velocity of the process liquid flowing in the pipe and shear forces between the jet and the process liquid. Such a slower layer of jet is gradually entrained by the pipe flow (in the longitudinal direction of the pipe) and it forms two vortices mixing spirally in opposite directions, the vortices being capable of entraining the process liquid flowing in the pipe and any solids or chemicals moving therewith.

The jet is gradually divided into these two vortices tending to essentially spread to the whole cross-section of the pipe (in reality the amount of the mixers needed for this depends on the diameter of the pipe) due to the effect of the vortices until their kinetic energy is no more sufficient to control the pipe flow and to counteract the uncontrollable turbulence being generally formed in the pipe flow. The vertical line M in FIG. 1*a* shows the point of the flow field where the counter-rotating spirals are formed, i.e. the point where those parts of the jet that were the first to start rotating have in a way returned to the mixer side of the process pipe. In practice this means that the injected mixture of chemical and injection liquid tends to approach the side of the wall of the pipe from which it was a moment ago introduced. As one moves farther to the right from the line M, the two counter-rotating vortices become weaker, i.e. the vortices are unified more clearly and they disappear into the general uncontrolled turbulence of the pipe flow. When the above-mentioned exact operation of the injection mixer was compared to the mixer arrangement described in the previously mentioned WO application discussing production of PCC, it was noted that the certain type of efficiently mixing and expanding flow field (shown in FIG. 1*b*) formed by each injection mixer into the flow had in the arrangement of the WO application time to mostly attenuate before the second mixer, located at a later point in the process pipe.

When this behavior of the flow field after one injection nozzle was explained in detail and the attenuation of the flow field prior to the introduction of the second chemical was observed, it was deduced that the mixing must be very intensive in the area where the jet discharged from the injection mixer tends to widen essentially to the whole cross-section of the process pipe. This was an impetus for finding out how more energy can be brought to the flow field of one injection mixer for at least keeping the vortex strong enough for good mixing or even increasing its strength. The tendency of the counter-rotating vortices to expand so as to cover the whole diameter of the pipe despite the fact that a single jet does not extend to the opposite side of the pipe was the reason for looking for increasing the strength. A solution for this was to try locating the second injection nozzle so close to the first nozzle that the flow field formed by the first nozzle has so far not been attenuated too much.

Figure 2A:
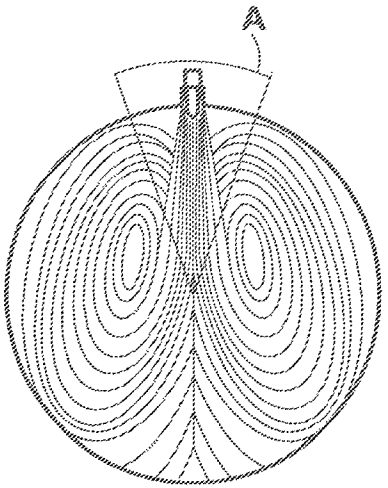
Figure 2A:
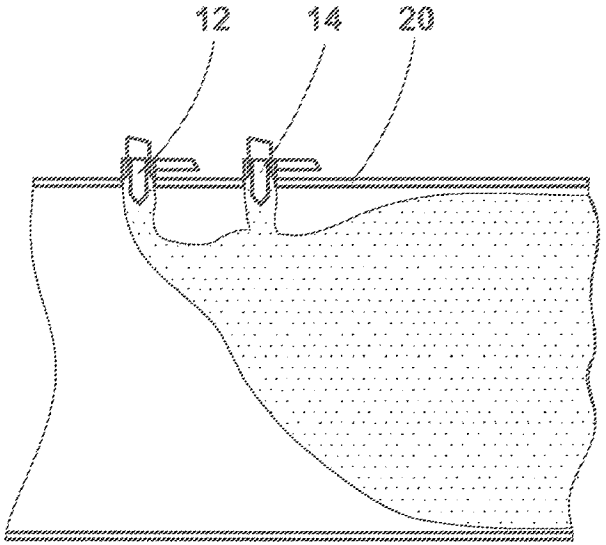

The following example, shown in connection with FIGS. 2A and 2B, relates to the in-line production of PCC using the solution described briefly above. In other words, the solution shown in FIG. 2*a* was tested, in which the injection nozzles are located sequentially very close to each other in the process pipe and not, as has been proposed in some context, side by side in circumferential direction. The injection nozzles located side-by-side on the circumference of the process pipe were supposed to increase mixing efficiency, but in our tests showing the operation of the flow field it could be observed that this does not in reality happen, unless a very powerful injection be used, thereby also requiring much more pumping power, thus producing a very powerful uncontrollable chaos-type mixing. The novel test arrangement was the result of examining e.g. in the process pipe the flow field of a chemical injected into a flow as shown in FIG. 1A.

FIG. 2A shows schematically an apparatus according to an embodiment of the invention for introducing various flows into the process liquid flow and FIG. 2B shows the flow field formed by means of the apparatus. Reference number 20 shows a process pipe in which the process liquid, in this example stock, flows to the right towards the headbox of a paper machine. An injection mixer 12 is fastened to the wall of the process pipe 20, the mixer being used for introducing e.g. carbon dioxide into the stock when producing PCC. A second injection mixer 14 is arranged at a very short distance from the first mixer 12, on the wall of the process pipe 20, by means of which lime milk is introduced into the stock. The injecting is carried out by using a special injection liquid, as is typical for the TrumpJet mixers of Wetend Technologies Oy, because with the injection liquid the chemicals, in this example CO2 and lime milk, an aqueous suspension of powdery Ca(OH)2, can be efficiently, quickly and evenly mixed into the stock. In addition to using the stock already flowing in pipe 20 by taking a side flow and pumping it to the injection mixer as injection liquid, a filtrate from the paper machine or another place in the process or a stock or filler component of papermaking may be used, just to mention a few alternatives. Further, a characterizing feature of the injecting is that when the chemical and a portion of the injection liquid tend to react immediately, it is advantageous that the introduction and mixing of the chemical are effected with the injection liquid so that the chemical is brought into contact with the injection liquid essentially simultaneously when their combination is injected into the process liquid. It is also essential that the injecting take place essentially perpendicularly to the flow direction of the process liquid. The term "essentially perpendicular direction" means here a direction at right angles to or deviating at most 30 degrees therefrom in relation to the flow direction of the process liquid. If desired, it is possible that the amount of the chemicals is only a fraction of the amount of the injection liquid, because by using relatively small amounts of injection liquid the penetration and even mixing of even a very small amount of chemical deep into the process liquid is ensured.

In our tests we learned that the best location for the second nozzle 14 was firstly the essentially same plane running along the axis of the pipe 10 in which the first nozzle 12 is located, because in this case the jet of the second nozzle 14 can be made to hit directly to between the two counter-rotating vortices formed by the previous nozzle 12, whereby the latter jet most efficiently enhances the vortices formed by the former one, brings more energy into them and thus helps the vortices to expand to as wide a cross-section as possible. In other words, the injection nozzles are located essentially sequentially on the wall of the process pipe. In this case also the term "essentially sequentially" means, in addition to being exactly one after the other, also being located at most 20 degrees either way away from the location. In other words the mixers form a mixer pair so that the injection mixer 14 of each mixer pair introducing the second flow is arranged in a location the position of which on the circumference of the process pipe 20 deviates at most 20 degrees, more preferably 10 degrees (measured in the direction of the circumference of the pipe) from the plane running along the axis of the process pipe onto which the first mixer 12 is located. Thus, the second injection mixer 14 is in a way located in a sector of 40 degrees (shown as sector A in FIG. 2*b*), preferably 20 degrees in the longitudinal direction of the process pipe 20, on the diameter of which sector the first mixer 12 is located. It was secondly observed that the second nozzle 14 should be located either near the line M of FIG. 1A or as near to it as possible. In other words the second nozzle 14 should be located either where the chemical jet introduced by the first nozzle has had time to form two counter-rotating spiral vortices or as near to it as possible. Thus it is possible to ensure that the jet of the second nozzle 14 enhances the jet of the first nozzle 12 and the kinetic energy of the jet of the second nozzle 14 is not lost for reaccelerating the already attenuated vortex formed by the first nozzle. Then, if the second injection mixer does not coincide with the above-defined angular position after the first mixer, its jet hits the side and partly counteracts the vortex formed by the first jet, leading to an uncontrolled flow field deteriorating the mixing result at least to a degree.

On the basis of our tests we found 0.2 meters to be the most preferable distance between the introduction nozzles for in-line production of PCC, i.e. when the flow velocity is of the order of 3 m/s, the time between the introduction points is 0.67 seconds. The velocities of the chemical-injection liquid jets emitted from the nozzles 12 and 14 are about 3 to 12 times the velocity of the stock flowing in the pipe. When comparing the flow fields of FIGS. 1*b* and 2*b*, it may be seen that the enhancement of the vortices caused by the second nozzle 14 increase the mixing rate of the chemicals on the whole cross-sectional area of the pipe so that already after about 0.15 seconds from the introduction of the first chemical both chemicals are distributed on essentially the whole cross-section of the pipe. In our tests we noticed that, depending to a degree on the viscosity of the process liquid, the longitudinal distance of the process pipe between the mixers should not essentially exceed two meters, because then the vortices of the first jet are attenuated too much. Thus, the distance between the injection nozzles in the longitudinal direction of the process pipe should be from 0.05 to 2 meters, preferably from 0.05 to 1 meter.

In real industrial scale processes it is not always possible to introduce one chemical with one injection mixer/mixer pair, mainly due to the diameter of the pipe. In this case there is a number of injection mixers/mixer pairs located on the same circumference of the process pipe. When using the standard-sized injection mixers made by Wetend Technologies Oy with small pipes it is possible to use only one nozzle, while with the largest pipe diameters from 4 to 6 mixers are needed on the same circumference of the pipe for sufficiently covering the cross-section of the pipe. Thus it is obvious that the best mixing result in mixing two chemicals is achieved when the second chemical is also introduced from the same number of injection mixers as the first chemical and the mixer pairs thus formed are located at essentially the same longitudinal diameter planes, which are distributed evenly on the circumference of the process pipe. It is also obviously preferable to have the mixers introducing the first chemical essentially on the same circumference of the process pipe and those introducing the second chemical on the other circumference.

A solution worth mentioning as a special application of the inventive solution is one in which two separate chemicals are not mixed, but instead only one chemical that can be introduced either from both injection mixers or only from the first injection mixer, whereby the second injection mixer would only inject a jet of injection liquid for enhancing the mixing into the process liquid flow.

The above-mentioned invention allows the use of more aggressive and effective chemicals, as the mixing is clearly faster and more even than previously. Simultaneously, however, the actual chemical or chemicals and their reaction products can tend to fasten to the walls of the reactor or other structures in the reactor area. Thus, in order to ensure efficient operation of the reactor it should be provided with means for keeping the surfaces of the reactor and the structures of the reactor area clean.

Figure 3:
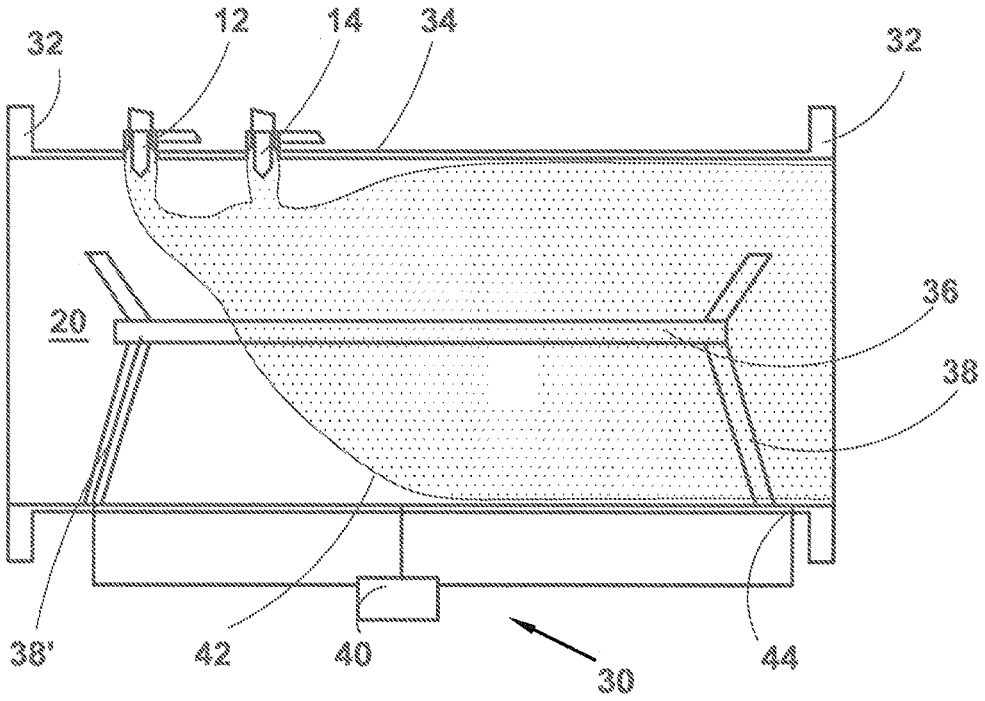
FIG. 3 schematically shows yet another preferred further embodiment of the invention.

In the above, when talking about the problems leading to the development of the invention, a cleaning apparatus used in connection with mixing chemicals having a tendency to precipitate or fasten was mentioned. FIG. 3 shows relatively schematically the introduction apparatus according to an additional embodiment of the invention and a pipe cleaning apparatus 30. In fact, FIG. 3 shows a reactor comprising a straight cylindrical process pipe 20 limited by flanges 32, the wall 34 of the reactor being provided with two chemical introduction nozzles 12 and 14 located close to each other as already described in the embodiment discussed above. An electrically conductive electrode rod 36 is connected essentially centrally, i.e. essentially on the axis of the process pipe, to the inside of the process pipe 20 by means of arms 38, the rod 36 being in this embodiment connected electrically by means of one arm 38 Æ to a control arrangement 40. The electrode rod 36 should be electrically isolated from the process pipe 20, in case the process pipe 20 is made of metal, as it in most cases is. The isolation may be carried out by e.g. providing the fastening arms 38 of the rod 36 from an electrically non-conductive material or by manufacturing the rod 36 mainly from an electrically non-conductive material and coating it with an electrically conductive material. The second electrode 42 is arranged on the inside of the process pipe 20 so that the desired voltage difference can be formed between the inner surface of the process pipe 20 and the electrode rod 36 located in the middle of the pipe. The second electrode naturally is, like the first one, electrically connected to the control arrangement 40. The simplest and also the most usual way is to have the process pipe made of metal, whereby it can act as an electrode in its entirety and no separate electrode is needed. When the process pipe is made of non-conductive material, there may be a number of second electrodes, preferably evenly distributed both in the circumferential direction of the process pipe as well as in the longitudinal direction of the reactor. Another alternative is to coat the process pipe internally with an electrically conductive material, whereby the coating acts as the electrode.

The third component connected to the control arrangement 40 is some kind of a measurement sensor 44 by means of which it is possible to monitor the efficiency of the mixing and/or the progress of the reactions in the reactor. The sensor 44 may be based on e.g. tomography, but it may as well measure the pH or conductivity of the process liquid.

According to the invention, the reactor can preferably, but not necessarily, be constructed so that all conduits, pipelines, pumps and cleaning means needed for injection mixing are located inside the pipeline within the length defined by flanges 32, whereby the installation of the reactor in the pipeline is as easy as possible.

The reactor wall cleaning arrangement shown in FIG. 3 works in the production of PCC so that a DC voltage is directed via the control arrangement to the electrode and the electrode located in connection with the wall of the reactor so that the electrode rod acts as a cathode and the wall of the reactor acts as the anode. When the wall of the process pipe is the anode, the pH of the liquid adjacent the wall drops to a value of 2 to 3, which prevents calcium carbonate from fastening to the wall. However, calcium carbonate has a tendency to precipitate/fasten to the surface of the electrode rod when the pH is high near the surface. The disadvantages arising from the precipitation are easy to eliminate by programming the control arrangement to change the polarity of the arrangement, whereby the carbonate is quickly dissolved in the acid liquid formed near the electrode now acting as the anode. The control arrangement can be programmed to change the polarity either at certain time intervals or controlled by a control impulse received from the process. It is, for example, possible to monitor the voltage change between the cathode and the anode, whereby a certain increase in voltage in practice means a precipitation layer of a certain depth. Thus the control arrangement can be calibrated to change the polarity of the arrangement at a certain potential difference. Correspondingly, when the potential difference has been decreased to the initial level, the control arrangement returns the polarity back to the initial situation.

Even though the electrode rod has in the above, in FIG. 3, been described as being essentially centrally installed in the process pipe/reactor, it is some cases possible to install it also in a slanted position in relation to the axis of the reactor. Such a solution is especially possible when the reactor/flow pipe makes a pipe elbow in which the reaction however progresses. In this case it is possible to arrange centrally extending electrode rods to the straight portions of the flow pipe on both sides of the pipe elbow with a still straight electrode rod between them in the pipe elbow, which is naturally preferably installed so that its effect on the cleaning of the area of the pipe elbow is the best possible. Especially with wide flow pipes it may be necessary to use a number of parallel electrode rods. Thus it is possible to make sure that the pH value of the liquid in the vicinity of the surface to be kept clean is on the desired range. It is further worth mentioning in connection with the electrode rod that when the reaction product or compound with tendency to precipitate or fasten is formed either only by the chemicals introduced from the injection mixers or from the common effect of them both, the electrode rod can be located so that its first end is level with the second injection mixer 14. Thus the first end thereof preferably extends in the flow direction of the process liquid until the point where all chemicals are used up. Naturally, when the first injection mixer is used for introducing chemical that alone has a tendency to precipitate on or to fasten to the wall of the process pipe or the like, the electrode rod must be positioned to begin on the level of the first injection mixer.

Figure 4:
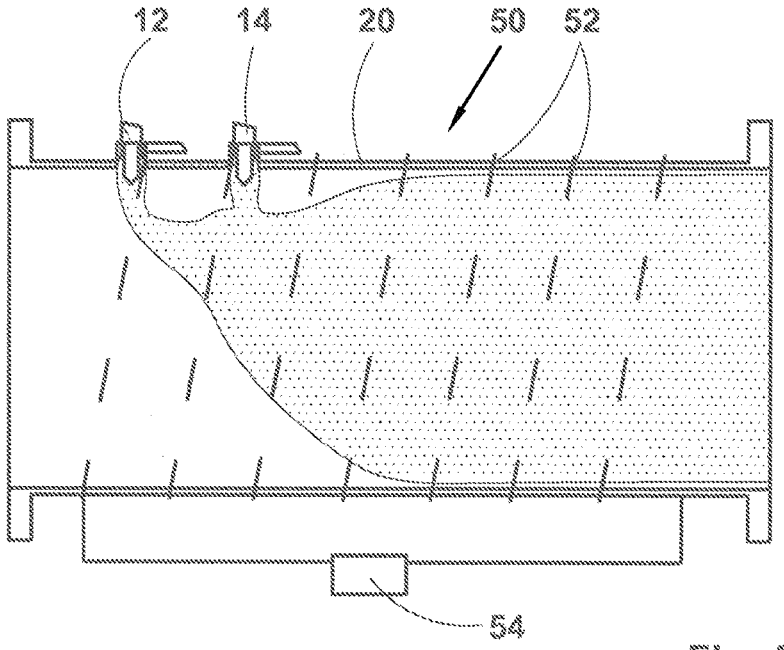
FIG. 4 schematically shows another preferred further embodiment of the invention.

FIG. 4 shows very schematically, as another embodiment of the present invention, another way of carrying out the crystallization reaction of the calcium carbonate in papermaking so that carbonate is not allowed to attach to any wetted surface at or adjacent to the reaction zone. A wetted surface is a surface exposed to the process flow. This other method is to arrange a permanent magnet or electric magnet 50 around the flow pipe 20. Such apparatuses are disclosed in for example U.S. Pat. Nos. 5,725,778 and 5,738,766. The permanent magnet forms a magnetic field the direction and strength of which are constant. It is possible to arrange the electric magnet 50 in connection with the flow pipe e.g. by winding an electric conductor 52 around the flow pipe 20 and directing an electric current into the coil formed thus. By changing the amplitude, direction and/or frequency of the electric current by means of the control unit 54 the direction and strength of the formed magnetic field can be changed as desired. It is additionally possible to direct electric current into the coil of the electric magnet 50 as waves of different shapes. However, whether the magnetic field is created by means of a permanent magnet or an electric magnet, the operation principle is always the same. An electric field is induced by the magnet inside the flow pipe. In order to be able to use the electric field the suspension flowing in the pipe must contain ions, in this case calcium ions and their counter ions (carbonate ions or hydrogen-carbonate ions). The electric field causes the ions in its range to be directed as required by their own charge in relation to the electric field. The mere existence of the electric field at a limited length in the flow pipe and especially the changes in the direction of the electric field turn the ions going with the flow as they tend to be directed according to the changes of the electric field and finally leading to the ionic bonds releasing and the ions are free to react with each other and to form calcium carbonate crystals. In other words, the electric field and especially its changes of direction accelerate the mutual chemical reaction of the ions, because the continuous changes of direction of the ions help their even mixing in the suspension. Additionally, the formed calcium carbonate crystals are immediately in such a phase that they cannot be attached to the surfaces of the flow pipe and form precipitations or, if they form precipitations, they are so soft that they are immediately entrained in the flow with a suitable flow speed. As far as the location of the electric magnet is concerned, the location rules defined above in connection with the electrode rules still apply.

Yet another usable way of preventing the formation of precipitations inside the reactor is to use an isolated electrode preferably centrally located inside the reactor, the electrode being electrically connected to the current source/control unit only. Another electrode is e.g. the surface of the reactor either isolated from the liquid or in electric connection with the liquid. In both cases a number of capacitive layers connected in series are formed, through which the electrostatic potential and the intensity of the field are transferred. In other words, in this case as well the electric field induced in the liquid phase causes desirable changes in the particles normally having a tendency to precipitate. This method is discussed in e.g. U.S. Pat. No. 5,591,317.

A fourth way of managing the crystallization reactions of chemicals in a process flow so that precipitations cannot fasten to any surfaces located in the reaction zone is, as has been mentioned in connection with the support arms of the electrode rod, to either produce such pieces, i.e. both the flow pipe and the structures located inside it in the reaction zone, from such materials that the precipitations do not attach to it. Polyamide may be mentioned as an example of materials usable in a number of applications. PE resin, polyurethane, Teflon<< and epoxy resin are usable as surface or coating materials. Further, surface topography, preferably the so-called nanosurface, may also be used in this application.

It should be noted that only a few of the most preferred embodiments are disclosed above. Thus, it is obvious that the invention is not limited to the above-mentioned embodiments but it can be applied in many ways within the scope defined by the appended claims. It is thereby obvious that a description concentrating on the production of PCC must be understood only as a good example of the usability of the invention for an efficient mixing of chemicals, because the mixing of the constituent materials of PCC and their immediate reaction with each other gives a clear picture of the great advantages of the inventive process compared to prior art solutions. Further, the alternative of feeding, in addition to introducing one chemical with a single injection mixer, two chemicals or chemical mixtures can be introduced should be considered. Similarly, one injection mixer pair can be used for introducing, in addition to one chemical from one or both nozzles also a number of chemicals from either one mixer or both mixers. Further, it is naturally possible to connect sequentially more than the two mixers as described above for the invention. The features disclosed in connection with various embodiments can also be used in connection with other embodiments within the inventive scope and/or different assemblies can be combined from the disclosed features, should it be desired and should it be technically feasible.

I claim:

1. A method to introduce a first flow and a second flow into a process liquid flowing through a process pipe, the method comprising:

injecting the first flow as at least two jets into the process liquid in the process pipe, wherein each of the at least two jets of the first flow is transverse to a flow direction of the process liquid proximate to the injection of the first flow;

forming mixing fields by the injection of the at least two jets of the first flow, wherein each of the mixing fields comprises a pair of counter-rotating vortices in the process liquid in which the vortices rotate in opposite directions with respect to an axis of one of the at least two jets of the first flow forming one of the mixing fields, and injecting the second flow as at least two jets into the process liquid, wherein each of the at least two jets injecting the second flow is transverse to the flow direction and is injected between one of the pairs of the counter-rotating vortices.

2. The method as recited in claim 1, further comprising suppressing precipitation or deposits of a chemical introduced with the first or the second flow or a product of a reaction with the chemical introduced with the first or the second flow onto a wetted surface of the process pipe or on a wetted structure located in the pipe by forming the pipe or the structure from or coating the structure with a material to which the chemical or the product does not attach or deposit.

3. The method recited in claim 1, wherein the injections of the first and second flows are made with pairs of injection mixers attached to the process pipe, and the injection mixers of each of the pairs are in a plane parallel to an axis of the process pipe.

4. The method recited in claim 3, wherein each of the pairs of injection mixers includes an upstream mixer and a downstream mixer, the downstream mixer is in a sector of an imaginary circle centered on the axis of the process pipe and perpendicular to the axis, wherein radial sides of the sector form an angle of at most 40 degrees and the sector is bisected by the plane which includes the upstream mixer of the pair of injection mixers.

5. The method recited in claim 3, further comprising at least one additional pair of injection mixers positioned on the process pipe, and wherein the pairs of injection mixers are arranged symmetrically around the axis of the process pipe.

6. The method recited in claim 1, further comprising suppressing precipitation or depositing on a wetted surface of the process pipe of at least one chemical introduced with the first or second flows or a reaction product of the at least one chemical.

7. The method as recited in claim 6 wherein the suppression includes applying an electric or magnetic field to or proximate to the wetted surface to affect a pH of a layer in the flow of the process liquid adjacent the wetted surface.

8. The method as recited in claim 6, wherein the suppression includes applying an electric field or a magnetic field to or proximate to the wetted surface to suppress deposition of material entrained with the process liquid.

* * * * *